US010274192B2

(12) United States Patent
Truong et al.

(10) Patent No.: US 10,274,192 B2
(45) Date of Patent: Apr. 30, 2019

(54) TUBE ARRANGEMENT IN A ONCE-THROUGH HORIZONTAL EVAPORATOR

(71) Applicant: Alstom Technology Ltd., Braden (CH)

(72) Inventors: Vinh Q. Truong, Southington, CT (US); Christopher J. Lech, Feeding Hills, MA (US); Jeffrey F. Magee, Longemadow, MA (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 503 days.

(21) Appl. No.: 13/744,112

(22) Filed: Jan. 17, 2013

(65) Prior Publication Data

US 2013/0180471 A1 Jul. 18, 2013

Related U.S. Application Data

(60) Provisional application No. 61/587,332, filed on Jan. 17, 2012, provisional application No. 61/587,428,
(Continued)

(51) Int. Cl.
*F22B 29/06* (2006.01)
*F22D 5/34* (2006.01)
(Continued)

(52) U.S. Cl.
CPC ..... *F22B 29/06* (2013.01); *F22B 15/00* (2013.01); *F22D 5/34* (2013.01); *F28D 7/082* (2013.01);
(Continued)

(58) Field of Classification Search
CPC ..... F22B 17/00; F22B 17/12; F22B 17/14; F22B 29/06; F22B 15/00; F28F 2009/224;
(Continued)

(56) References Cited

U.S. PATENT DOCUMENTS 343,258 A * 6/1886 Smith ..... 122/154
459,998 A * 9/1891 Davis ..... 122/359
(Continued)

FOREIGN PATENT DOCUMENTS

CH 144501 A * 12/1930 ..... F22B 17/12
CN 2420739 Y 2/2001
(Continued)

OTHER PUBLICATIONS

Wilhelm et al., Jan. 17, 2012, U.S. Appl. No. 61/587,402.
(Continued)

*Primary Examiner* — Steven B McAllister
*Assistant Examiner* — Steven Anderson, II
(74) *Attorney, Agent, or Firm* — GE Global Patent Operation; Stephen G. Midgley

(57) ABSTRACT

Disclosed herein is a once-through evaporator comprising an inlet manifold; one or more inlet headers in fluid communication with the inlet manifold; one or more tube stacks, where each tube stack comprises one or more inclined evaporator tubes; the one or more tube stacks being in fluid communication with the one or more inlet headers; where the inclined tubes are inclined at an angle of less than 90 degrees or greater than 90 degrees to a vertical; one or more outlet headers in fluid communication with one or more tube stacks; and an outlet manifold in fluid communication with the one or more outlet headers.

4 Claims, 12 Drawing Sheets

Related U.S. Application Data filed on Jan. 17, 2012, provisional application No. 61/587,359, filed on Jan. 17, 2012, provisional application No. 61/587,402, filed on Jan. 17, 2012.

(51) Int. Cl.

| | |
|---|---|
| ***F28F 1/00*** | (2006.01) |
| ***F28F 9/013*** | (2006.01) |
| ***F28F 9/22*** | (2006.01) |
| ***F28F 9/26*** | (2006.01) |
| ***F28D 7/08*** | (2006.01) |
| ***F22B 15/00*** | (2006.01) |
| ***F28F 9/02*** | (2006.01) |

(52) U.S. Cl.

CPC ..... *F28F 1/00* (2013.01); *F28F 9/013* (2013.01); *F28F 9/0275* (2013.01); *F28F 9/22* (2013.01); *F28F 9/26* (2013.01); *Y10T 137/0324* (2015.04)

(58) Field of Classification Search

CPC ..... F28F 9/013; F28F 9/22; F28F 9/26; F28F 9/0275; F28F 1/00; F28D 7/082; F22D 5/34

USPC ..... 122/1 B

See application file for complete search history.

(56) References Cited

U.S. PATENT DOCUMENTS

| | | | | | |
|---|---|---|---|---|---|
| 505,735 | A | | 9/1893 | Vanes | |
| 1,256,220 | A | | 2/1918 | Fulton | |
| 1,521,864 | A | | 1/1925 | Broido | |
| 1,569,050 | A | | 1/1926 | Swartz, Jr. | |
| 1,764,981 | A | | 6/1930 | Rehfuss | |
| 1,814,447 | A | * | 7/1931 | Jones | 122/303 |
| 1,827,946 | A | * | 10/1931 | Mayr | 122/235.24 |
| 1,884,778 | A | | 10/1932 | Lucke et al. | |
| 1,895,220 | A | * | 1/1933 | Grebe | 122/33 |
| 1,924,850 | A | | 8/1933 | Freiday | |
| 1,965,427 | A | * | 7/1934 | Nerad | 122/235.16 |
| 2,800,887 | A | | 7/1957 | Profos | |
| 2,847,192 | A | | 8/1958 | Smith et al. | |
| 3,004,529 | A | | 10/1961 | Argersinger et al. | |
| 3,368,534 | A | | 2/1968 | Gorzegno et al. | |
| 3,447,602 | A | * | 6/1969 | Dalin | F22B 21/00 122/356 |
| 3,789,806 | A | | 2/1974 | Gorzegno | |
| 3,854,455 | A | * | 12/1974 | Carson | C10G 9/20 110/205 |
| 3,896,874 | A | | 7/1975 | Bongaards et al. | |
| 4,246,872 | A | | 1/1981 | Skinner et al. | |
| 4,290,389 | A | | 9/1981 | Palchik | |
| 4,331,105 | A | | 5/1982 | Kawamura et al. | |
| 4,336,642 | A | | 6/1982 | Engelberts | |
| 4,532,985 | A | | 8/1985 | Cutler | |
| 4,638,857 | A | | 1/1987 | Fournier | |
| 4,676,305 | A | | 6/1987 | Doty | |
| 4,915,062 | A | | 4/1990 | Dolezal | |
| 4,976,310 | A | | 12/1990 | Jabs | |
| 5,097,819 | A | | 3/1992 | Talbert et al. | |
| 5,265,129 | A | | 11/1993 | Brooks et al. | |
| 5,293,842 | A | | 3/1994 | Loesel | |
| 5,366,452 | A | | 11/1994 | Widlund et al. | |
| 5,398,644 | A | | 3/1995 | Nilsson et al. | |
| 5,412,936 | A | | 5/1995 | Lee et al. | |
| 5,540,276 | A | | 7/1996 | Adams et al. | |
| 5,560,322 | A | | 10/1996 | Fitzgerald | |
| 5,628,183 | A | | 5/1997 | Rice | |
| 6,019,070 | A | | 2/2000 | Duffy | |
| 6,055,803 | A | | 5/2000 | Mastronarde | |
| 6,062,017 | A | | 5/2000 | Liebig | |
| 6,173,679 | B1 | | 1/2001 | Brueckner et al. | |
| 6,189,491 | B1 | | 2/2001 | Wittchow et al. | |
| 6,244,330 | B1 | | 6/2001 | Eisinger et al. | |
| 6,311,647 | B1 | | 11/2001 | Liebig et al. | |
| 6,557,500 | B1 | | 5/2003 | Schroeder | |
| 6,820,685 | B1 | | 11/2004 | Carter | |
| 6,868,807 | B2 | | 3/2005 | Franke et al. | |
| 6,957,630 | B1 | | 10/2005 | Mastronarde | |
| 7,017,529 | B1 | | 3/2006 | Lomax, Jr. et al. | |
| 7,428,374 | B2 | | 9/2008 | Franke et al. | |
| 7,770,544 | B2 | | 8/2010 | Viskup, Jr. | |
| 7,886,538 | B2 | | 2/2011 | Schottler et al. | |
| 7,963,097 | B2 | | 6/2011 | Mastronarde | |
| 2001/0023665 | A1 | | 9/2001 | Heidrich | |
| 2003/0051501 | A1 | | 3/2003 | Matsushina et al. | |
| 2003/0164232 | A1 | | 9/2003 | Inoue et al. | |
| 2004/0069244 | A1 | | 4/2004 | Schroeder | |
| 2005/0194120 | A1 | | 9/2005 | Lomax, Jr. et al. | |
| 2006/0075977 | A1 | | 4/2006 | Franke et al. | |
| 2006/0192023 | A1 | | 8/2006 | Franke et al. | |
| 2007/0084418 | A1 | | 4/2007 | Gurevich | |
| 2007/0119388 | A1 | | 5/2007 | Waseda et al. | |
| 2008/0104960 | A1 | | 5/2008 | Lomax | |
| 2008/0121387 | A1 | | 5/2008 | Taniguchi et al. | |
| 2008/0190382 | A1 | | 8/2008 | Bruckner et al. | |
| 2008/0282997 | A1 | | 11/2008 | Gayheart et al. | |
| 2009/0071419 | A1 | | 3/2009 | Franke et al. | |
| 2009/0151654 | A1 | | 6/2009 | Ando | |
| 2009/0241859 | A1 | | 10/2009 | Bairley et al. | |
| 2010/0181053 | A1 | | 7/2010 | Hecht et al. | |
| 2010/0200203 | A1 | | 8/2010 | Postma et al. | |
| 2011/0041783 | A1 | | 2/2011 | Brueckner | |
| 2011/0056668 | A1 | | 3/2011 | Taras et al. | |
| 2011/0162594 | A1 | | 7/2011 | Brueckner et al. | |
| 2011/0174472 | A1 | | 7/2011 | Kurochkin et al. | |
| 2011/0225972 | A1 | | 9/2011 | Brueckner et al. | |
| 2011/0239961 | A1 | | 10/2011 | Bauver, II et al. | |
| 2012/0180739 | A1 | | 7/2012 | Rop et al. | |
| 2013/0062036 | A1 | | 3/2013 | Treptow et al. | |
| 2014/0216365 | A1 | | 8/2014 | Rancruel et al. | |

FOREIGN PATENT DOCUMENTS

| | | | |
|---|---|---|---|
| CN | 2429730 | Y | 5/2001 |
| CN | 1546191 | A | 11/2004 |
| CN | 1745227 | A | 3/2006 |
| CN | 1745277 | A | 3/2006 |
| CN | 101311624 | A | 11/2008 |
| CN | 101457978 | A | 6/2009 |
| CN | 201277766 | Y | 7/2009 |
| CN | 201476631 | U | 5/2010 |
| CN | 101726202 | A | 6/2010 |
| CN | 101784861 | A | 7/2010 |
| CN | 102128557 | A | 7/2011 |
| CN | 102239363 | A | 11/2011 |
| DE | 612 960 | | 5/1935 |
| FR | 1324002 | A | 4/1963 |
| GB | 28236 | A | 12/1913 |
| GB | 104356 | A | 2/1917 |
| GB | 490457 | A | 8/1938 |
| GB | 717420 | A | 10/1954 |
| GB | 865426 | | 4/1961 |
| GB | 913010 | A | 12/1962 |
| JP | S57-188905 | A | 11/1982 |
| JP | 0275806 | A | 3/1990 |
| JP | 0663606 | B2 | 8/1994 |
| JP | 06229503 | A | 8/1994 |
| JP | 6045154 | Y2 | 11/1994 |
| JP | 06341604 | A | 12/1994 |
| JP | 09243002 | A | 9/1997 |
| JP | H09-303701 | A | 11/1997 |
| JP | H11-337003 | A | 12/1999 |
| JP | 2000018501 | A | 1/2000 |
| JP | 2002206888 | A | 7/2002 |
| JP | 2003-014202 | A | 1/2003 |
| JP | 2008180501 | A | 8/2008 |
| KR | 10-0316460 | B1 | 3/1996 |
| KR | 100284392 | B1 | 4/2001 |
| KR | 20010090529 | A | 10/2001 |
| KR | 20060132944 | A | 12/2006 |
| KR | 20070088654 | A | 8/2007 |

(56) References Cited

FOREIGN PATENT DOCUMENTS

| | | | |
|---|---|---|---|
| KR | 20090003233 | A | 1/2009 |
| KR | 20110009042 | U | 9/2011 |
| WO | 8404797 | A1 | 12/1984 |
| WO | 2004011046 | A1 | 2/2004 |
| WO | 2007/133071 | | 11/2007 |
| WO | 2013/002869 | A2 | 1/2013 |
| WO | 2013/109769 | A2 | 7/2013 |

OTHER PUBLICATIONS

Magee, Jan. 17, 2013, U.S. Appl. No. 13/744,104.
Pschirer, Jan. 17, 2012, U.S. Appl. No. 61/557,230.
Lech et al., Jan. 17, 2013, U.S. Appl. No. 13/744,126.
Magee et al., Jan. 17, 2013, U.S. Appl. No. 13/744,094.
Wilhelm et al., Jan. 17, 2013, U.S. Appl. No. 13/744,121.
An unofficial translation of Korean Notice of Allowance issued in connection with related KR Application No. 1020137019933 dated Oct. 27, 2016.
U.S. Final Office Action issued in connection with Related U.S. Appl. No. 13/744,126 dated Feb. 7, 2017.
Machine Translation and a Office Action issued in connection with corresponding ID Application No. W00201302869 dated Aug. 1, 2017.
Magee, J.F., et al., Once-through horizontal evaporator for a heat recovery steam generator, GE co-pending U.S. Appl. No. 61/587,332, filed Jan. 17, 2012.
Magee, J.F., Start up system for a once-through horizontal evaporator, GE co-pending U.S. Appl. No. 61/587,428, filed Jan. 17, 2012.
Wilhelm, B.W., et al., An apparatus and method of controlling fluid flow through a once-through horizontal evaporator, GE co-pending U.S. Appl. No. 61/587,359, filed Jan. 17, 2012.
Wilhelm, B.W., et al., Apparatus and method of dynamically controlling fluid flow through a for once-through horizontal evaporator, GE co-pending U.S. Appl. No. 61/587,402, filed Jan. 17, 2012.
Pschirer, J.D., Method and apparatus for connecting sections of a once-through horizontal evaporator, GE co-pending U.S. Appl. No. 61/587,230, filed Jan. 17, 2012.
PCT Search Report and Written Opinion issued in connection with Related PCT Application No. PCT/US2013/021962 dated Sep. 12, 2013.
PCT Search Report and Written Opinion issued in connection with Related PCT Application No. PCT/IB2013/050455 dated Sep. 12, 2013.
PCT Search Report and Written Opinion issued in connection with Related PCT Application No. PCT/IB2013/050457 dated Feb. 20, 2014.
PCT Invitation to Pay Additional Fees issued in connection with Related PCT Application No. PCT/IB2013/050459 dated Feb. 24, 2014.
PCT Search Report and Written Opinion issued in connection with Related PCT Application No. PCT/IB2013/050459 dated May 27, 2014.
Unofficial English Translation of Korean Office Action issued in connection with Related KR Application No. 1020137019920 dated Aug. 8, 2014.
U.S. Non-Final Office Action issued in connection with Related U.S. Appl. No. 13/744,126 dated Dec. 18, 2014.
Unofficial English Translation of Chinese Office Action and Search Report issued in connection with Related CN Application No. 201380000532.9 dated Jan. 14, 2015.
Unofficial English Translation of Korean Office Action issued in connection with Related KR Application No. 1020137019933 dated Jan. 23, 2015.
Unofficial English Translation of Korean Office Action issued in connection with Related KR Application No. 1020137021217 dated Jan. 23, 2015.
Unofficial English Translation of Korean Office Action issued in connection with Related KR Application No. 1020137021477 dated Jan. 23, 2015.
Unofficial English Translation of Chinese Office Action and Search Report issued in connection with Related CN Application No. 201380000533.3 dated Mar. 17, 2015.
Unofficial English Translation of Korean Notice of Allowance issued in connection with Related KR Application No. 1020137019920 dated Apr. 27, 2015.
U.S. Notice of Allowance issued in connection with Related U.S. Appl. No. 13/744,104 dated May 20, 2015.
Unofficial English Translation of Chinese Office Action and Search Report issued in connection with Related CN Application No. 201380000531.4 dated May 27, 2015.
U.S. Non-Final Office Action issued in connection with Related U.S. Appl. No. 13/744,094 dated May 27, 2015.
U.S. Final Office Action issued in connection with Related U.S. Appl. No. 13/744,126 dated Jul. 21, 2015.
Unofficial English Translation of Mexican Office Action issued in connection with Related MX Application No. MX/a/2013/008238 dated Jul. 27, 2015.
Unofficial English Translation of Chinese Office Action and Search Report issued in connection with Related CN Application No. 201380000530.X dated Sep. 6, 2015.
U.S. Non-Final Office Action issued in connection with Related U.S. Appl. No. 13/744,121 dated Sep. 28, 2015.
Unofficial English Translation of Korean Office Action issued in connection with Related KR Application No. 1020137019933 dated Oct. 29, 2015.
Unofficial English Translation of Indonesian Office Action issued in connection with Related ID Application No. W00201302867 dated Nov. 5, 2015.
Unofficial English Translation of Korean Notice of Allowance issued in connection with Related KR Application No. 1020137021217 dated Nov. 27, 2015.
Unofficial English Translation of Korean Office Action issued in connection with Related KR Application No. 1020137021477 dated Dec. 24, 2015.
Unofficial English Translation of CN Office Action and Search Report issued in connection with Related CN Application No. 201380000531.4 dated Dec. 24, 2015.
U.S. Final Office Action Issued in connection with Related U.S. Appl. No. 13/744,094 dated Jan. 13, 2016.
Unofficial English Translation of Korean Office Action issued in connection with Related KR Application No. 1020137019933 dated Feb. 26, 2016.
Unofficial English Translation of Chinese Office Action and Search Report issued in connection with Related CN Application No. 201380000530.X dated Apr. 25, 2016.
U.S. Final Office Action Issued in connection with Related U.S. Appl. No. 13/744,121 dated May 20, 2016.
European Office Action issued in connection with corresponding EP Application No. 13707443.1 dated May 25, 2016.
U.S. Non-Final Office Action issued in connection with Related U.S. Appl. No. 13/744,094 dated Jun. 28, 2016.
U.S. Non-Final Office Action issued in connection with Related U.S. Appl. No. 13/744,126 dated Jul. 28, 2016.
Unofficial English Translation of Mexican Office Action issued in connection with Related MX Application No. MX/a/2013/008024 dated Jul. 28, 2016.
First Office Action issued in connection with corresponding KR Application No. 10-2016-7015030 dated Dec. 19, 2017.

* cited by examiner (Side view)

270
262
264
210(n+1)
240
210(n)
A
B
θ1
280
280
C
Gas
Flow
270

TUBE ARRANGEMENT IN A ONCE-THROUGH HORIZONTAL EVAPORATOR

CROSS-REFERENCE TO RELATED APPLICATIONS

This disclosure claims priority to U.S. Provisional Application No. 61/587,332 filed Jan. 17, 2012, U.S. Provisional Application No. 61/587,428 filed Jan. 17, 2012, U.S. Provisional Application No. 61/587,359 filed Jan. 17, 2012, and U.S. Provisional Application No. 61/587,402 filed Jan. 17, 2012, the entire contents of which are all hereby incorporated by reference.

TECHNICAL FIELD

The present disclosure relates generally to a heat recovery steam generator (HRSG), and more particularly, to a tube for controlling flow in an HRSG having inclined tubes for heat exchange.

BACKGROUND

A heat recovery steam generator (HRSG) is an energy recovery heat exchanger that recovers heat from a hot gas stream. It produces steam that can be used in a process (cogeneration) or used to drive a steam turbine (combined cycle). Heat recovery steam generators generally comprise four major components—the economizer, the evaporator, the superheater and the water preheater. In particular, natural circulation HRSG's contain evaporator heating surface, a drum, as well as the necessary piping to facilitate the appropriate circulation ratio in the evaporator tubes. A once-through HRSG replaces the natural circulation components with once-through evaporator and in doing so offers in-roads to higher plant efficiency and furthermore assists in prolonging the HRSG lifetime in the absence of a thick-walled drum.

An example of a once through evaporator heat recovery steam generator (HRSG) 100 is shown in the FIG. 1. In the FIG. 1, the HRSG comprises vertical heating surfaces in the form of a series of vertical parallel flow paths/tubes 104 and 108 (disposed between the duct walls 111 and acts as heat exchangers, hereinafter may also be referred to as 'first heat exchanger 104' and 'second heat exchanger 108' as and when required) configured to absorb the required heat. In the HRSG 100, a working fluid (e.g., water) is transported to an inlet manifold 105 from a source 106. The working fluid is fed from the inlet manifold 105 to an inlet header 112 and then to a first heat exchanger 104, where it is heated by hot gases from a furnace (not shown) flowing in the horizontal direction. The hot gases heat tube sections 104 and 108 disposed between the duct walls 111. A portion of the heated working fluid is converted to a vapor and the mixture of the liquid and vaporous working fluid is transported to the outlet manifold 103 via the outlet header 113, from where it is transported to a mixer 102, where the vapor and liquid are mixed once again and distributed to a second heat exchanger 108. This separation of the vapor from the liquid working fluid is undesirable as it produces temperature gradients and efforts have to be undertaken to prevent it. To ensure that the vapor and the fluid from the heat exchanger 104 are well mixed, they are transported to a mixer 102, from which the two phase mixture (vapor and liquid) are transported to another second heat exchanger 108 where they are subjected to superheat conditions. The second heat exchanger 108 is used to overcome thermodynamic limitations. The vapor and liquid are then discharged to a collection vessel 109 from which they are then sent to a separator 110, prior to being used in power generation equipment (e.g., a turbine). The use of vertical heating surfaces thus has a number of design limitations.

Due to design considerations, it is often the case that thermal head limitations necessitate an additional heating loop in order to achieve superheated steam at the outlet. Often times additional provisions are needed to remix water/steam bubbles prior to re-entry into the second heating loop, leading to additional design considerations. In addition, there exists a gas-side temperature imbalance downstream of the heating surface as a direct result of the vertically arranged parallel tubes. These additional design considerations utilize additional engineering design and manufacturing, both of which are expensive. These additional features also necessitate periodic maintenance, which reduces time for the productive functioning of the plant and therefore result in losses in productivity. It is therefore desirable to overcome these drawbacks.

SUMMARY

Disclosed herein is a once-through evaporator comprising an inlet manifold; one or more inlet headers in fluid communication with the inlet manifold; one or more tube stacks, where each tube stack comprises one or more inclined evaporator tubes; the one or more tube stacks being in fluid communication with the one or more inlet headers; where the inclined tubes are inclined at an angle of less than 90 degrees or greater than 90 degrees to a vertical; one or more outlet headers in fluid communication with one or more tube stacks; and an outlet manifold in fluid communication with the one or more outlet headers.

Disclosed herein too is a method comprising discharging a working fluid through a once-through evaporator; where the once-through evaporator comprises an inlet manifold; one or more inlet headers in fluid communication with the inlet manifold; one or more tube stacks, where each tube stack comprises one or more inclined evaporator tubes; the one or more tube stacks being in fluid communication with the one or more inlet headers; where the inclined tubes are inclined at an angle of less than 90 degrees or greater than 90 degrees to a vertical; one or more outlet headers in fluid communication with one or more tube stacks; and an outlet manifold in fluid communication with the one or more outlet headers; discharging a hot gas from a furnace or boiler through the once-through evaporator; and transferring heat from the hot gas to the working fluid.

BRIEF DESCRIPTION OF THE DRAWINGS

Referring now to the Figures, which are exemplary embodiments, and wherein the like elements are numbered alike.

DETAILED DESCRIPTION

Figure 1:
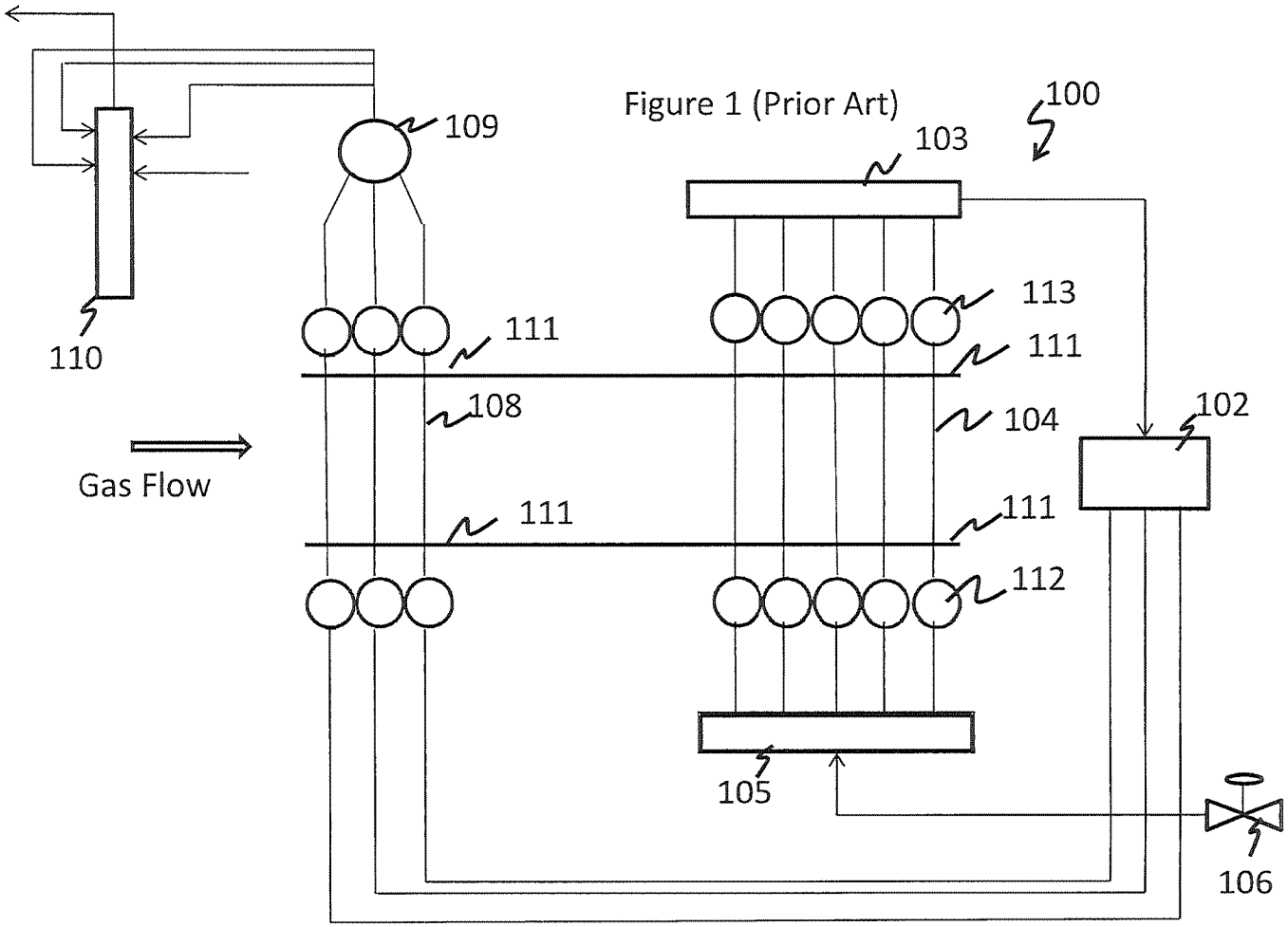
Figure 1 (Prior Art)
FIG. 1 is a schematic view of a prior art heat recovery steam generator having vertical heat exchanger tubes.
Figure 2:
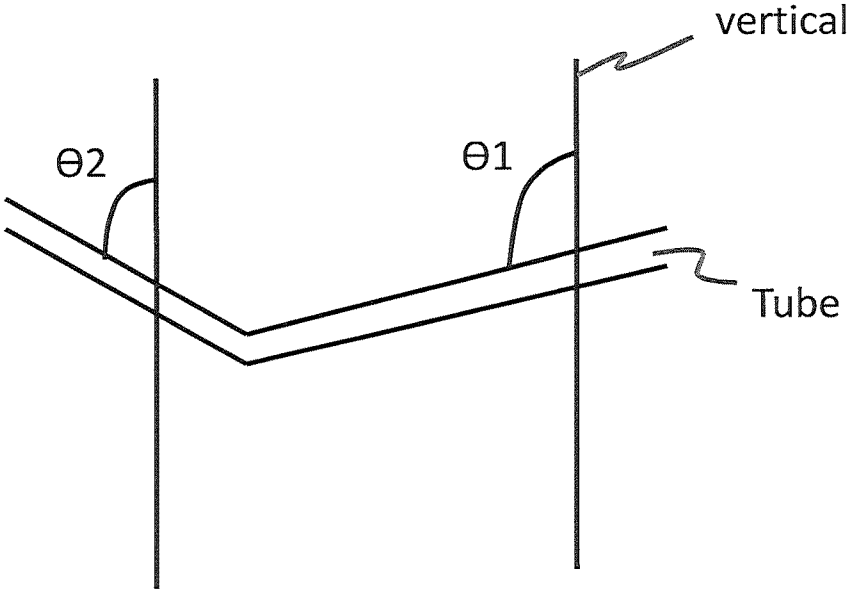
FIG. 2 depicts a schematic view of an exemplary once-through evaporator that uses a counterflow staggered arrangement.

Disclosed herein is a heat recovery steam generator (HRSG) that comprises a single heat exchanger or a plurality of heat exchangers whose tubes are arranged to be "non-vertical". By non-vertical, it is implied the tubes are inclined at an angle to a vertical. By "inclined", it is implied that the individual tubes are inclined at an angle less than 90 degrees or greater than 90 degrees to a vertical line drawn across a tube. In one embodiment, the tubes can be horizontal in a first direction and inclined in a second direction that is perpendicular to the first direction. These angular variations in the tube along with the angle of inclination are shown in the FIG. 2. The FIG. 2 shows a section of a tube that is employed in a tube stack of the once-through evaporator. The tube stack shows that the tube is inclined to the vertical in two directions. In one direction, it is inclined at an angle of θ1 to the vertical, while in a second direction it is inclined at angle of θ2 to the vertical. In the FIG. 2, it may be seen that θ1 and θ2 can vary by up to 90 degrees to the vertical. If the angle of inclination θ1 and θ2 are equal to 90 degrees, then the tube is stated to be substantially horizontal. If on the other hand only one angle θ1 is 90 degrees while the other angle θ2 is less than 90 degrees or greater than 90 degrees, then the tube is said to be horizontal in one direction while being inclined in another direction. In yet another embodiment, it is possible that both θ1 and θ2 are less than 90 degrees or greater than 90 degrees, which implies that the tube is inclined in two directions. It is to be noted that by "substantially horizontal" it is implies that the tubes are oriented to be approximately horizontal (i.e., arranged to be parallel to the horizon within ±2 degrees). For tubes that are inclined, the angle of inclination θ1 and/or θ2 generally vary from about 55 degrees to about 88 degrees with the vertical.

The section (or plurality of sections) containing the horizontal tubes is also termed a "once-through evaporator", because when operating in subcritical conditions, the working fluid (e.g., water, ammonia, or the like) is converted into vapor gradually during a single passage through the section from an inlet header to an outlet header. Likewise, for supercritical operation, the supercritical working fluid is heated to a higher temperature during a single passage through the section from the inlet header to the outlet header.

The once-through evaporator (hereinafter "evaporator") comprises parallel tubes that are disposed non-vertically in at least one direction that is perpendicular to the direction of flow of heated gases emanating from a furnace or boiler.

Figure 3:
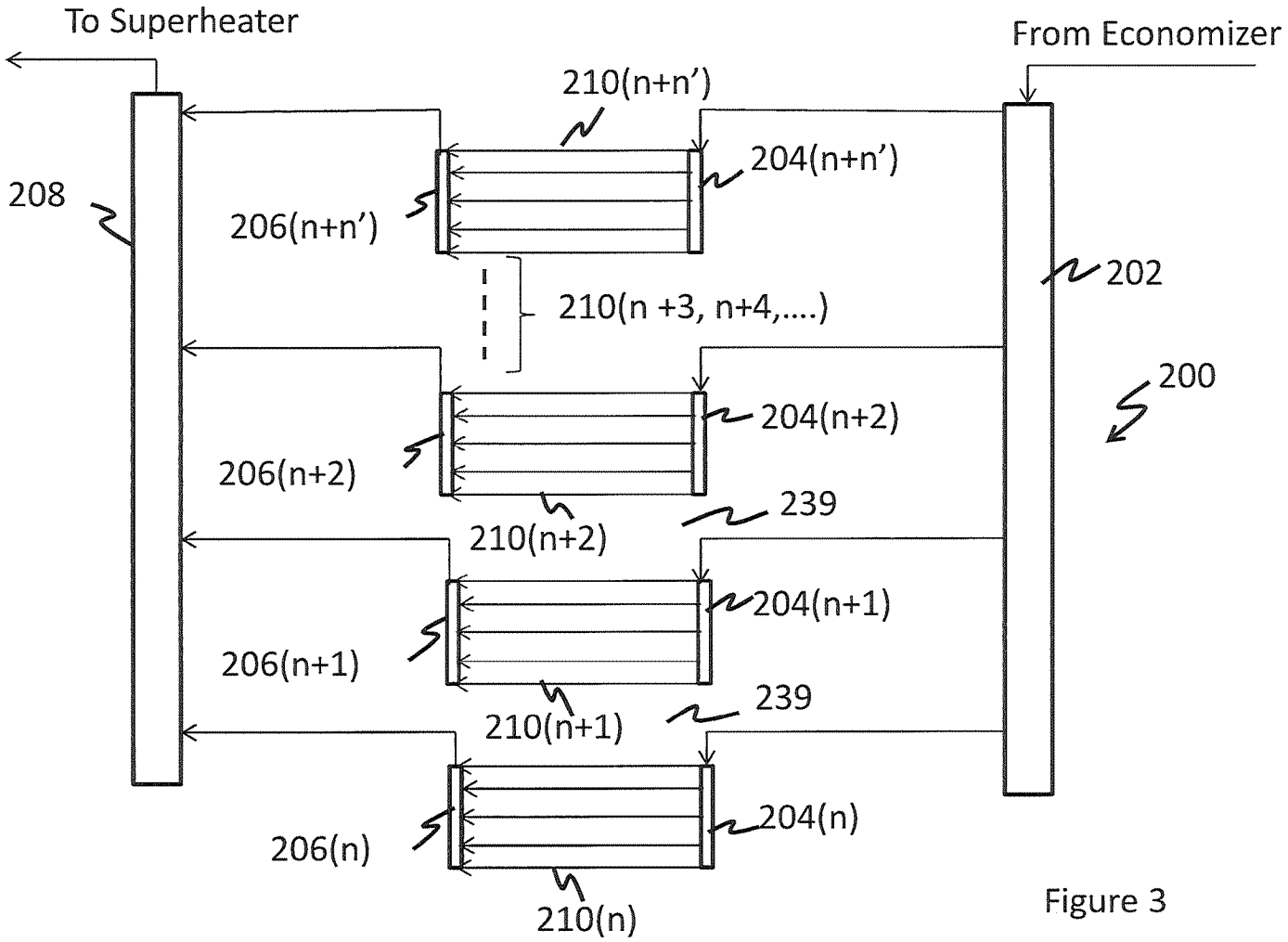
FIG. 3 depicts an exemplary embodiment of a once-through evaporator.
Figures 4A, 4B:
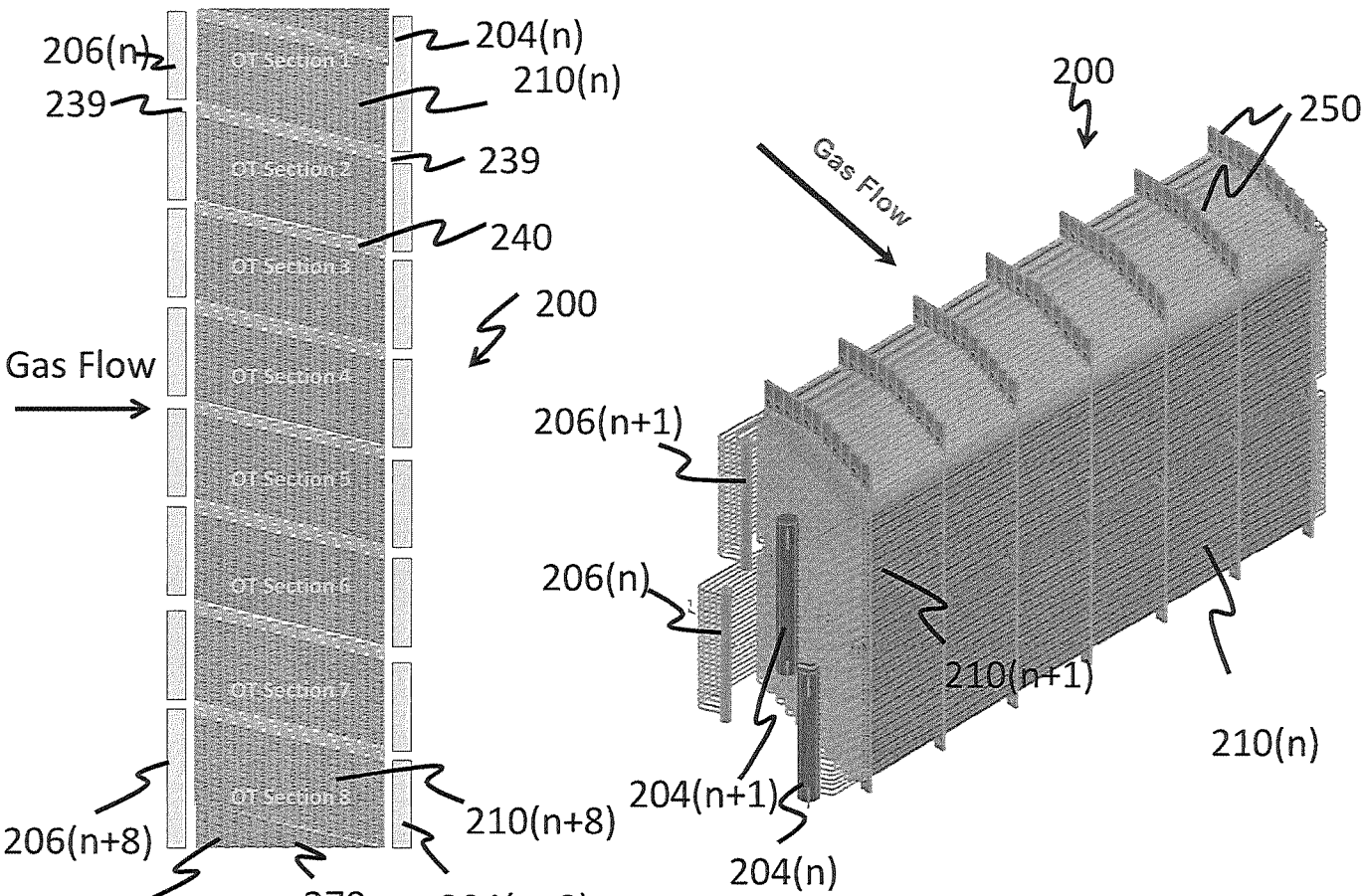
FIG. 4(A) depicts one exemplary arrangement of the tubes in a tube stack of a once-through evaporator.
FIG. 4(B) depicts an isometric view of an exemplary arrangement of the tubes in a tube stack of a once-through evaporator.

The FIGS. 3, 4(A), 4(B) and 10 depicts an exemplary embodiment of a once-through evaporator. The FIG. 3 depicts a plurality of vertical tube stacks in a once-through evaporator 200. In one embodiment, the tube stacks are aligned vertically so that each stack is either directly above, directly under, or both directly above and/or directly under another tube stack. The FIG. 4(A) depicts one exemplary arrangement of the tubes in a tube stack of a once-through evaporator; while the FIG. 4(B) depicts an isometric view of an exemplary arrangement of the tubes in a tube stack of a once-through evaporator;

The evaporator 200 comprises an inlet manifold 202, which receives a working fluid from an economizer (not shown) and transports the working fluid to a plurality of inlet headers 204(*n*), each of which are in fluid communication with vertical tube stacks 210(*n*) comprising one or more tubes that are substantially horizontal. The fluid is transmitted from the inlet headers 204(*n*) to the plurality of tube stacks 210(*n*). For purposes of simplicity, in this specification, the plurality of inlet headers 204(*n*), 204(*n*+1) . . . and 204(*n*+n'), depicted in the figures are collectively referred to as 204(*n*). Similarly the plurality of tube stacks 210(*n*), 210(*n*+1), 210(*n*+2) . . . and 210(*n*+n') are collectively referred to as 210(*n*) and the plurality of outlet headers 206(*n*), 206(*n*+1), 206(*n*+2) . . . and 206(*n*+n') are collectively referred to as 206(*n*).

As can be seen in the FIG. 3, multiple tube stacks 210(*n*) are therefore respectively vertically aligned between a plurality of inlet headers 204(*n*) and outlet headers 206(*n*). Each tube of the tube stack 210(*n*) is supported in position by a plate 250 (see FIG. 4(B)). The working fluid upon traversing the tube stack 210(*n*) is discharged to the outlet manifold 208 from which it is discharged to the superheater. The inlet manifold 202 and the outlet manifold 208 can be horizontally disposed or vertically disposed depending upon space requirements for the once-through evaporator. From the FIGS. 3 and 4(A), it may be seen that when the vertically aligned stacks are disposed upon one another, a passage 239 is formed between the respective stacks. A baffle system 240 may be placed in these passages to prevent the by-pass of hot gases. This will be discussed later.

The hot gases from a source (e.g., a furnace or boiler) (not shown) travel perpendicular to the direction of the flow of the working fluid in the tubes 210. With reference to the FIG. 3, the hot gases travel away from the reader into the plane of the paper, or towards the reader from the plane of the paper. In one embodiment, the hot gases travel counterflow to the direction of travel of the working fluid in the tube stack. Heat is transferred from the hot gases to the working fluid to increase the temperature of the working fluid and to possibly convert some or all of the working fluid from a liquid to a vapor. Details of each of the components of the once-through evaporator are provided below.

As seen in the FIGS. 3 and/or 4(A), the inlet header comprises one or more inlet headers 204(*n*), 204(*n*+1) . . . and (204(*n*) (hereinafter represented generically by the term "204(*n*)"), each of which are in operative communication with an inlet manifold 202. In one embodiment, each of the one or more inlet headers 204(*n*) are in fluid communication with an inlet manifold 202. The inlet headers 204(*n*) are in fluid communication with a plurality of horizontal tube stacks 210(*n*), 210(*n*+1), 210(*n*'+2) . . . and 210(*n*) respectively ((hereinafter termed "tube stack" represented generically by the term "210(*n*)"). Each tube stack 210(*n*) is in fluid communication with an outlet header 206(*n*). The outlet header thus comprises a plurality of outlet headers 206(*n*), 206(*n*+1), 206(*n*+2) . . . and 206(*n*), each of which is in fluid communication with a tube stack 210(*n*), 210(*n*+1), 210(*n*+2) . . . and 210(*n*) and an inlet header 204(*n*), 204(*n*+1), (204(*n*+2) . . . and 204(*n*) respectively.

The terms 'n'' is an integer value, while "n'" can be an integer value or a fractional value. n' can thus be a fractional value such as ½, ⅓, and the like. Thus for example, there can therefore be one or more fractional inlet headers, tube stacks or outlet headers. In other words, there can be one or more inlet headers and outlet headers whose size is a fraction of the other inlet headers and/or outlet headers. Similarly there can be tube stacks that contain a fractional value of the number of tubes that are contained in the other stack. It is to be noted that the valves and control systems having the reference numeral n' do not actually exist in fractional form, but may be downsized if desired to accommodate the smaller volumes that are handled by the fractional evaporator sections. In one embodiment, there can be at least one or more fractional tube stacks in the once-through evaporator. In another embodiment, there can be at least two or more fractional tube stacks in the once-through evaporator.

In one embodiment, the once-through evaporator can comprise 2 or more inlet headers in fluid communication with 2 or more tube stacks which are in fluid communication with 2 or more outlet headers. In one embodiment, the once-through evaporator can comprise 3 or more inlet headers in fluid communication with 3 or more tube stacks which are in fluid communication with 3 or more outlet headers. In another embodiment, the once-through evaporator can comprise 5 or more inlet headers in fluid communication with 5 or more tube stacks which are in fluid communication with 5 or more outlet headers. In yet another embodiment, the once-through evaporator can comprise 10 or more inlet headers in fluid communication with 10 or more tube stacks which are in fluid communication with 10 or more outlet headers. There is no limitation to the number of tube stacks, inlet headers and outlet headers that are in fluid communication with each other and with the inlet manifold and the outlet manifold. Each tube stack is sometimes termed a bundle or a zone.

Figure 10:
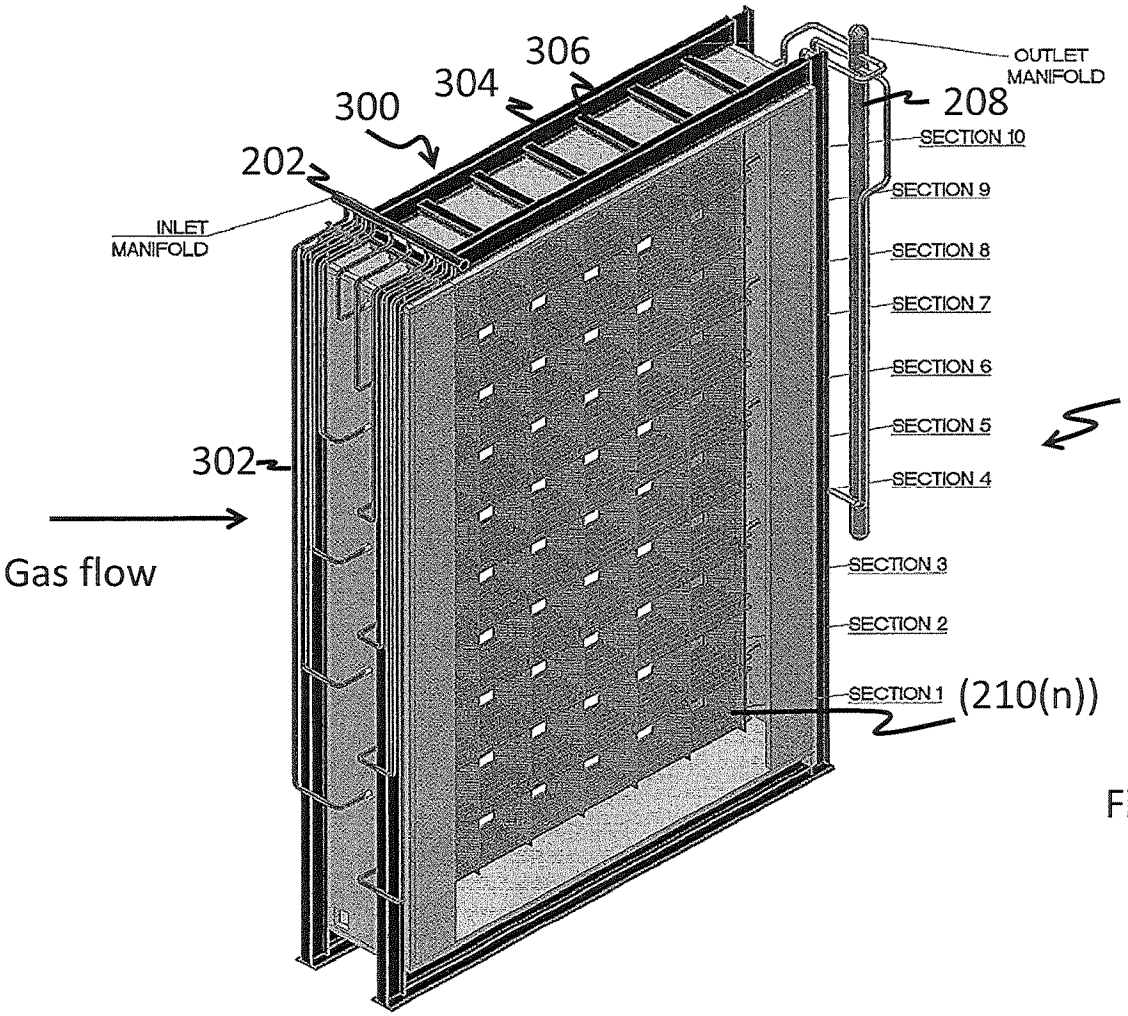
FIG. 10 depicts a once-through evaporator having 10 vertically aligned zones or sections that contain tubes, wherein hot gases can pass through the vertically aligned zones to transfer their heat to the working fluid flowing through the tubes.

The FIG. 10 depicts another exemplary assembled once-through evaporator. The FIG. 10 shows a once-through evaporator of the FIG. 3 having 10 vertically aligned tube stacks 210(*n*) that contain tubes through which hot gases can pass to transfer their heat to the working fluid. The tube stacks are mounted in a frame 300 that comprises two parallel vertical support bars 302 and two horizontal support bars 304. The support bars 302 and 304 are fixedly attached or detachably attached to each other by welds, bolts, rivets, screw threads and nuts, or the like.

Disposed on an upper surface of the once-through evaporator are rods 306 that contact the plates 250. Each rod 306 supports the plate and the plates hang (i.e., they are suspended) from the rod 306. The plates 250 (as detailed above) are locked in position using clevis plates. The plates 250 also support and hold in position the respective tube stacks 210(*n*). In this FIG. 10, only the uppermost tube and the lowermost tube of each tube tack 210(*n*) is shown as part of the tube stack. The other tubes in each tube stack are omitted for the convenience of the reader and for clarity's sake.

Since each rod 306 holds or supports a plate 250, the number of rods 306 are therefore equal to the number of the plates 250. In one embodiment, the entire once-through evaporator is supported and held-up by the rods 306 that contact the horizontal rods 304. In one embodiment, the rods 306 can be tie-rods that contact each of the parallel horizontal rods 304 and support the entire weight of the tube stacks. The weight of the once-through evaporator is therefore supported by the rods 306.

Each section is mounted onto the respective plates and the respective plates are then held together by tie rods 306 at the periphery of the entire tube stack. A number of vertical plates support these horizontal heat exchangers. These plates are designed as the structural support for the module and provide support to the tubes to limit deflection. The horizontal heat exchangers are shop assembled into modules and shipped to site. The plates of the horizontal heat exchangers are connected to each other in the field.

Figure 5:
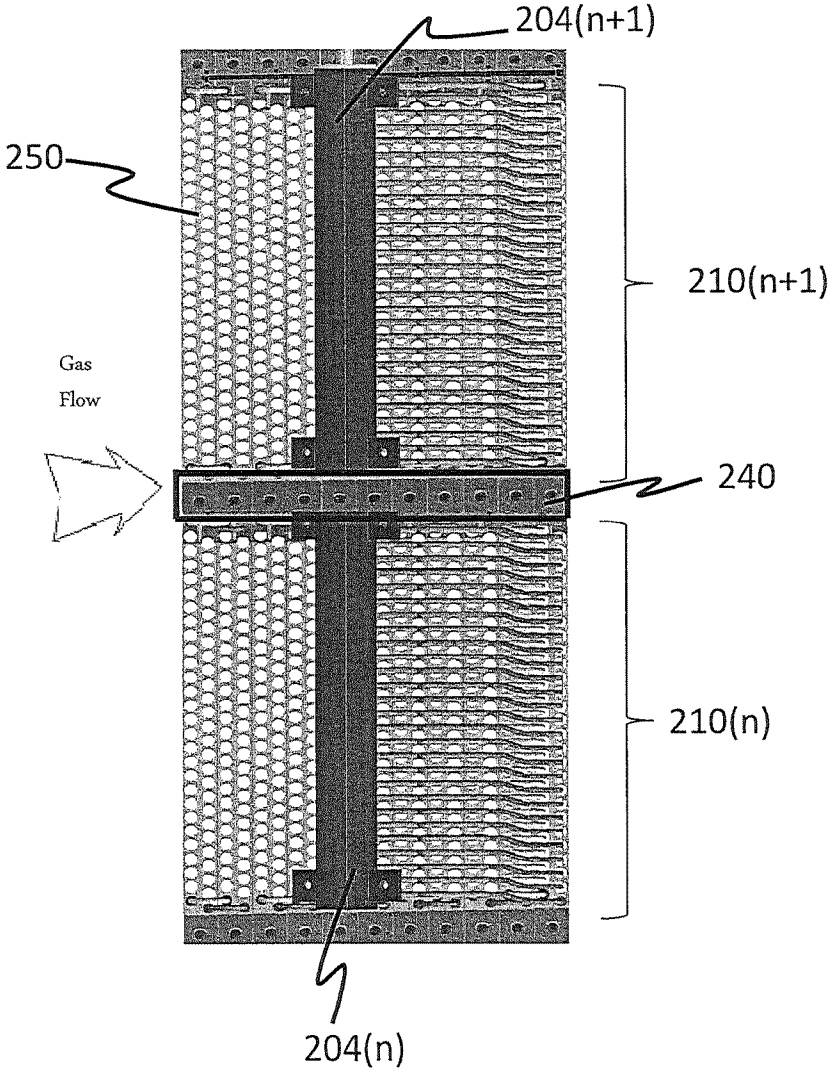
FIG. 5 depicts an end-on schematic view of a counterflow staggered arrangement of tubes in a tube stack in a once-through evaporator.

The FIG. 5 depicts one possible arrangement of the tubes in a tube stack. The FIG. 5 is an end-on view that depicts two tube stacks that are vertically aligned. The tube stacks 210(*n*) and 210(*n*+1) are vertically disposed on one another and are separated from each other and from their neighboring tube stacks by baffles 240. The baffles 240 prevent non-uniform flow distribution and facilitate staggered and counterflow heat transfer. In one embodiment, the baffles 240 do not prevent the hot gases from entering the once-through device. They facilitate distribution of the hot gases through the tube stacks. As can be seen in the FIG. 5, each tube stack is in fluid communication with a header 204(*n*) and 204(*n*+1) respectively. The tubes are supported by metal plates 250 that have holes through which the tubes travel back and forth. The tubes are serpentine i.e., they travel back and forth between the inlet header 204(*n*) and the outlet header 206(*n*) in a serpentine manner. The working fluid is discharged from the inlet header 204(*n*) to the tube stack, where it receives heat from the hot gas flow that is perpendicular to the direction of the tubes in the tube stack.

Figure 6A:
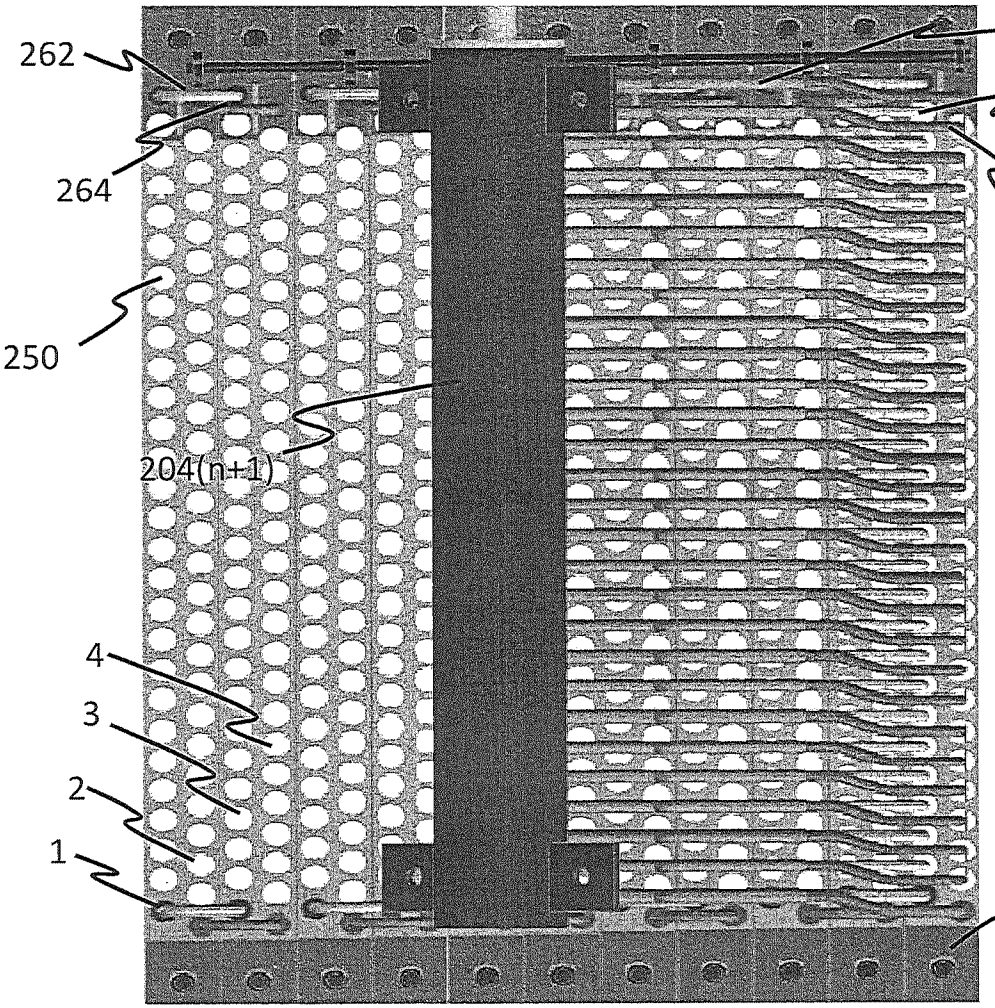
FIG. 6A is an expanded end-on view of a tube stack of the FIG. 4.

The FIG. 6A is an expanded end-on view of the tube stack 210(*n*+1) of the FIG. 5. In the FIG. 6A, it can be seen that two tubes 262 and 264 emanate from the inlet header 204(*n*+1). The two tubes 262 and 264 emanate from the header 204(*n*+1) at each line position 260. The tubes in the FIG. 6A are inclined from the inlet header 204(*n*) to the outlet header 206(*n*), which is away from the reader into the plane of the paper.

The tubes are in a zig-zag arrangement (as can be seen in the upper left hand of the FIG. 6A), with the tube 262 traversing back and forth in a serpentine manner between two sets of plates 250, while the tube 264 traverses back and forth in a serpentine manner between the two sets of plates 250 in a set of holes that are in a lower row of holes from the holes through which the tube 262 travels. It is to be noted, that while this specification details two sets of plates 250, the FIG. 5A shows only one plate 250. In actuality, each tube stack may be supported by two or more sets of plates as seen previously in the FIG. 4(B). In short, the tube 262 travels through holes in the odd numbered (1, 3, 5, 7, . . . ) columns in odd numbered rows, while the tube 264 travels through even numbered (2, 4, 6, 8, . . . ) columns in even numbered rows. This produces a zig-zag looking arrangement. This zig-zag arrangement is produced because the holes in even numbered hole columns of the metal plate are off-set from the holes in the odd numbered hole columns. As a result in the zig-zag arrangement; the tubes in one row are off set from the tubes in a preceding or succeeding row. With a staggered arrangement the heating circuit can lie in two flow paths so as to avoid low points in the boiler and the subsequent inability to drain pressure parts.

Figure 6B:
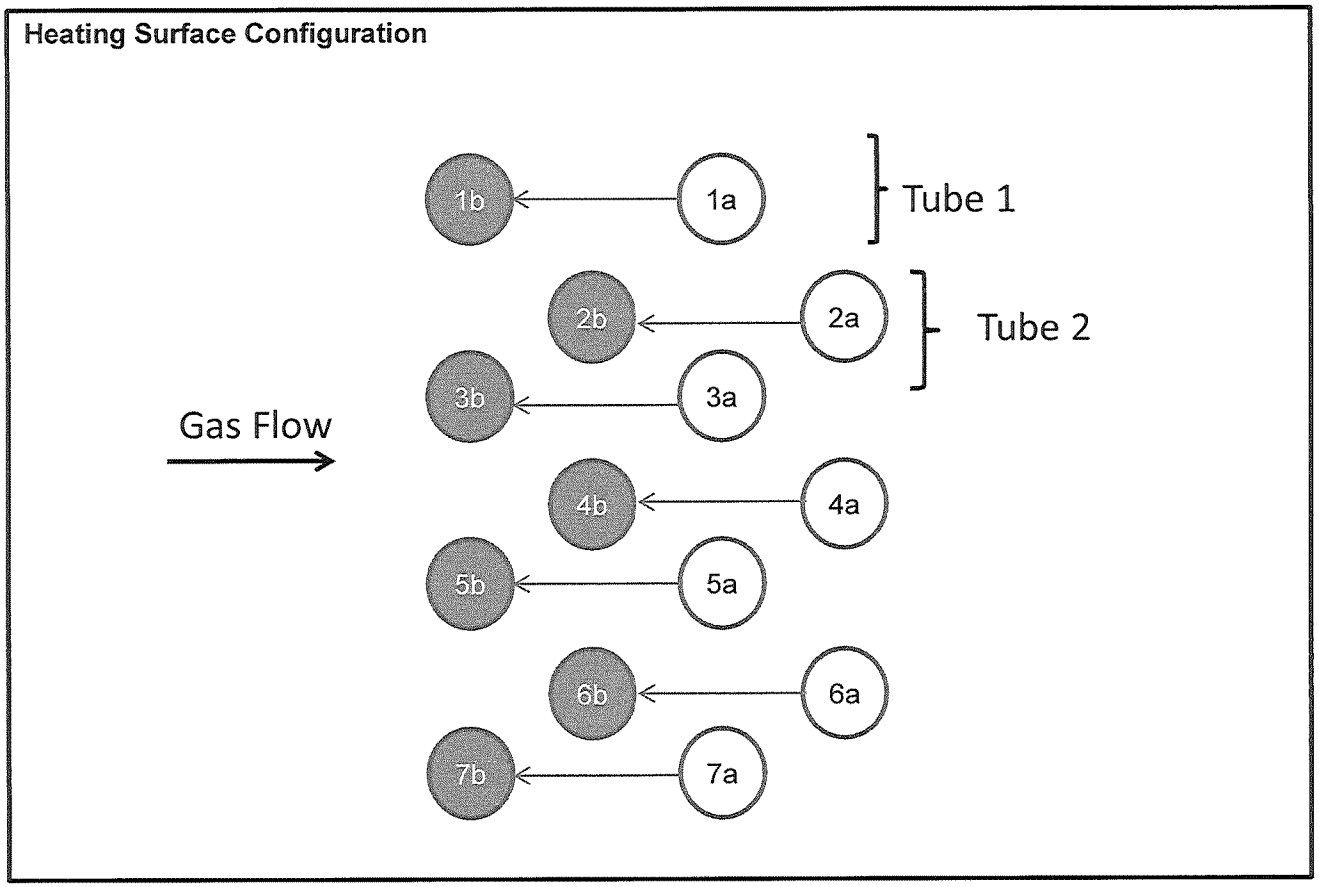
FIG. 6B is a depiction of a plane section taken within the tube stack of the FIG. 5A and depicts a staggered tube consideration.

The FIG. 6B is a depiction of a plane section taken within the tube stack. The plane is perpendicular to the direction of travel of fluid in the tubes and the FIG. 6B shows the cross-sectional areas of the 7 serpentine tubes at the plane. As can be seen, the tubes (as viewed by their cross-sectional areas) are in a staggered configuration. Because of the serpentine shape, the heating surface depicts the parallel tube paths in a staggered configuration that supports counterflow fluid flow and consequently counterflow heat transfer. By counterflow heat transfer it is meant that the flow in a section of a tube in one direction runs counter to the flow in another section of the same tube that is adjacent to it. The numbering shown in the FIG. 6B denotes a single water/steam circuit. For example in tube 1, the section 1*a* contains fluid flowing away from the reader, while the section of tube 1 next to it contains fluid that flows towards the reader. The different tube colors in the FIG. 6B indicates an opposed flow direction of the working fluid. The arrows show the direction of fluid flow in a single pipe.

Figure 7A:
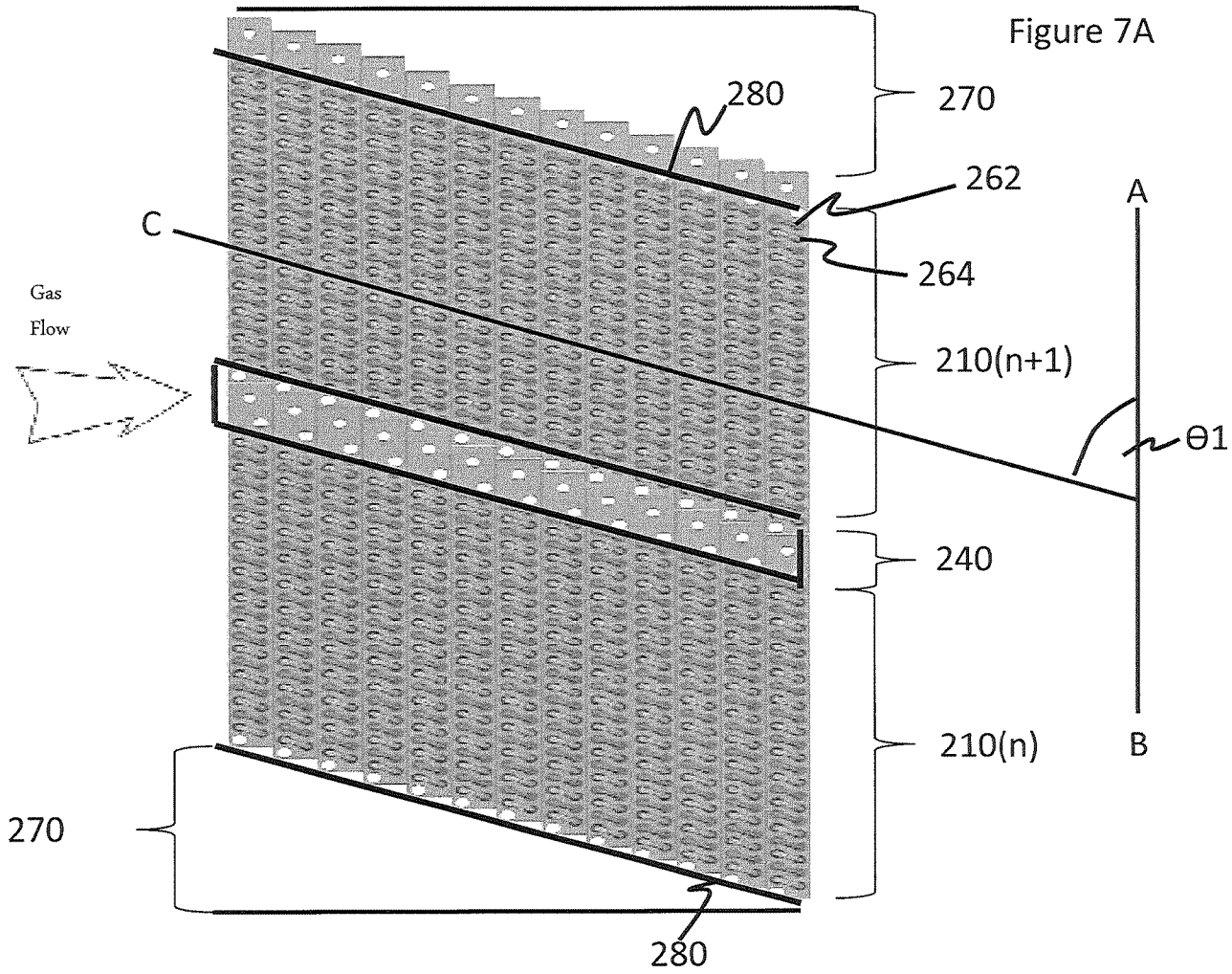
FIG. 7A depicts an elevation end-on view of tubes that are inclined in one direction while being horizontal in another direction; the tubes are arranged in a staggered fashion.

The FIG. 7A depicts an isometric end-on view of tubes that are inclined in one direction while being horizontal in another direction. In the case of the tubes of the FIG. 7A, the tubes are horizontal in a direction that is perpendicular to the hot gas flow, while being inclined at an angle of θ1 in a direction parallel to the hot gas flow. In one embodiment, the tube stack comprises tubes that are substantially horizontal in a direction that is parallel to a direction of flow of the hot gases and inclined in a direction that is perpendicular to the direction of flow of the hot gases. This will be discussed later in the FIG. 8.

The angle θ1 can vary from 55 degrees to 88 degrees, specifically from 60 degrees to 87 degrees, and more specifically 80 degrees to 86 degrees. The inclination of the tubes in one or more directions provides a space 270 between the duct wall 280 and the rectangular geometrical shape that the tube stack would have occupied if the tubes were not inclined at all. This space 270 may be used to house control equipment. This space may lie at the bottom of the stack, the top of the stack or at the top and the bottom of the stack. Alternatively, this space can be used to facilitate counterflow of the hot gases in the tube stack.

In one embodiment, this space 270 can contain a fractional stack, i.e., a stack that is a fractional size of the regular stack 210(*n*) as seen in the FIGS. 4(A) and 4(B). In another embodiment, baffles can also be disposed in the space to deflect the hot gases into the tube stack with an inline flow.

Figure 7B:
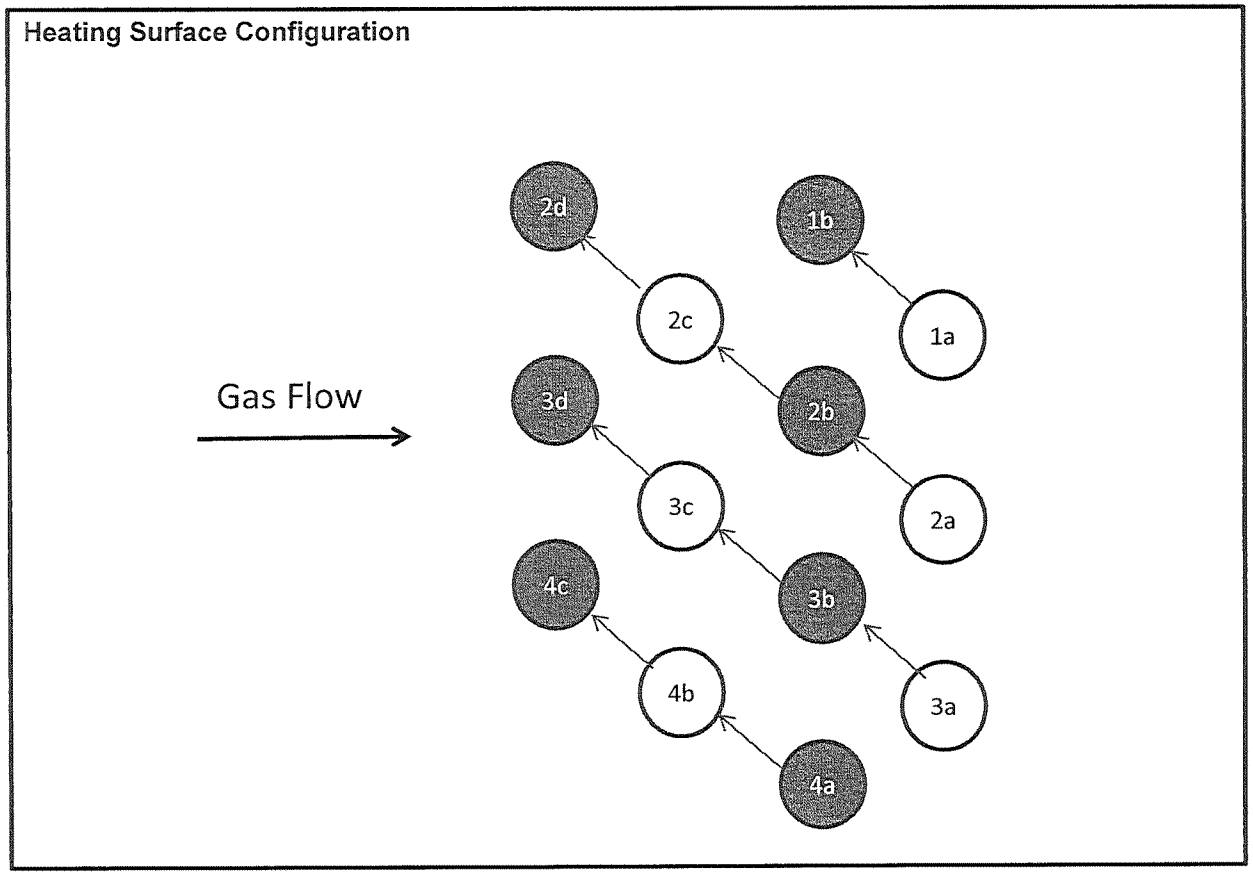
FIG. 7B is a depiction of a plane section taken within the tube stack of the FIG. 6A and depicts a staggered tube configuration.

In the FIG. 7A, it may be seen that tubes are also staggered with respect to the exhaust gas flow. This is depicted in FIG. 7B, which depicts a plane section taken within the tube stack. The plane is perpendicular to the direction of travel of the working fluid in the tubes. As in the case of the tubes of the FIG. 6B, the fluid flow in the FIG. 7B is also in a counterflow direction. The numbering shown in the FIG. 7B denotes a single water/steam circuit. The arrows show the direction of fluid flow in a single tube. Since the tubes in the tube stack are inclined, the working fluid travels upwards from right to left.

Figure 8:
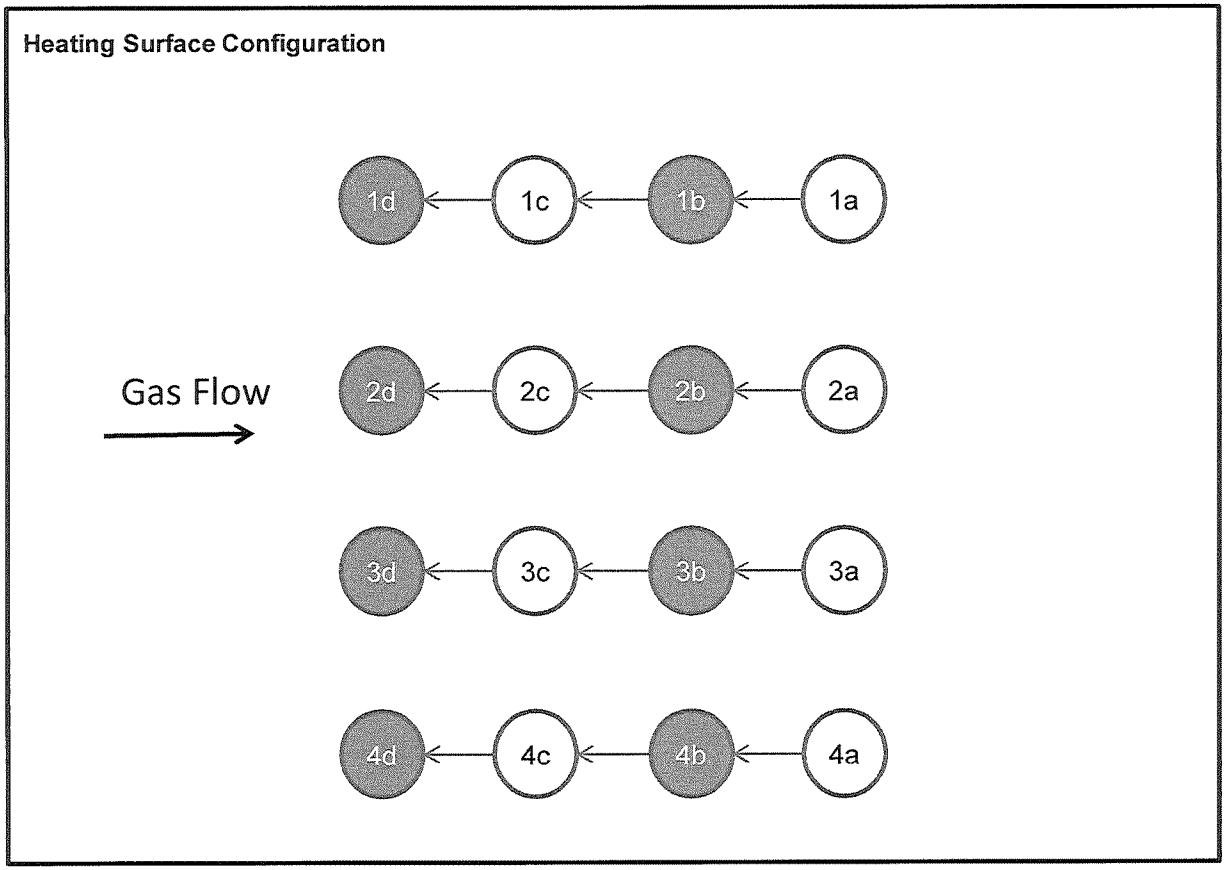
FIG. 8 is a depiction of a plane section taken within the tube stack that depicts an inline configuration.

The FIG. 8 depicts an "inline" flow arrangement that occurs when the tubes in the tube stacks are inclined in a direction that is perpendicular to the hot gas flow, while being horizontal in a direction that is parallel to the hot gas flow. The tubes are inclined from the inlet header to the outlet header away from the reader. This is referred to as the in-line arrangement. In this arrangement, the holes in even numbered hole columns of the metal plate are not off-set from the holes in the odd numbered hole columns. The tubes in the odd numbered rows of the tube stack lie approximately above the tubes in the even numbered rows of the tube stack. In the inline arrangement, the tubes in one row lie approximately above the tubes in a succeeding row and directly below the tubes in a preceding row. As in the case of the tubes of the FIG. 6B, the fluid flow is counterflow. The numbering shown in the FIG. 8 denotes a single water/steam circuit. The arrows show the direction of fluid flow in a single tube. While the FIGS. 5, 6B, 7A, 7B and 8 show the hot gas flow from left to right, it can also flow I the opposite direction from right to left.

This arrangement is advantageous because operational turn down is possible. However, it is to be noted that the heating surface is less efficient and can lead to an additional pressure drop on the side at which the hot gases first contact the tube stack. This in-line arrangement results in added tubes and exacerbates draining concerns.

Figure 9:
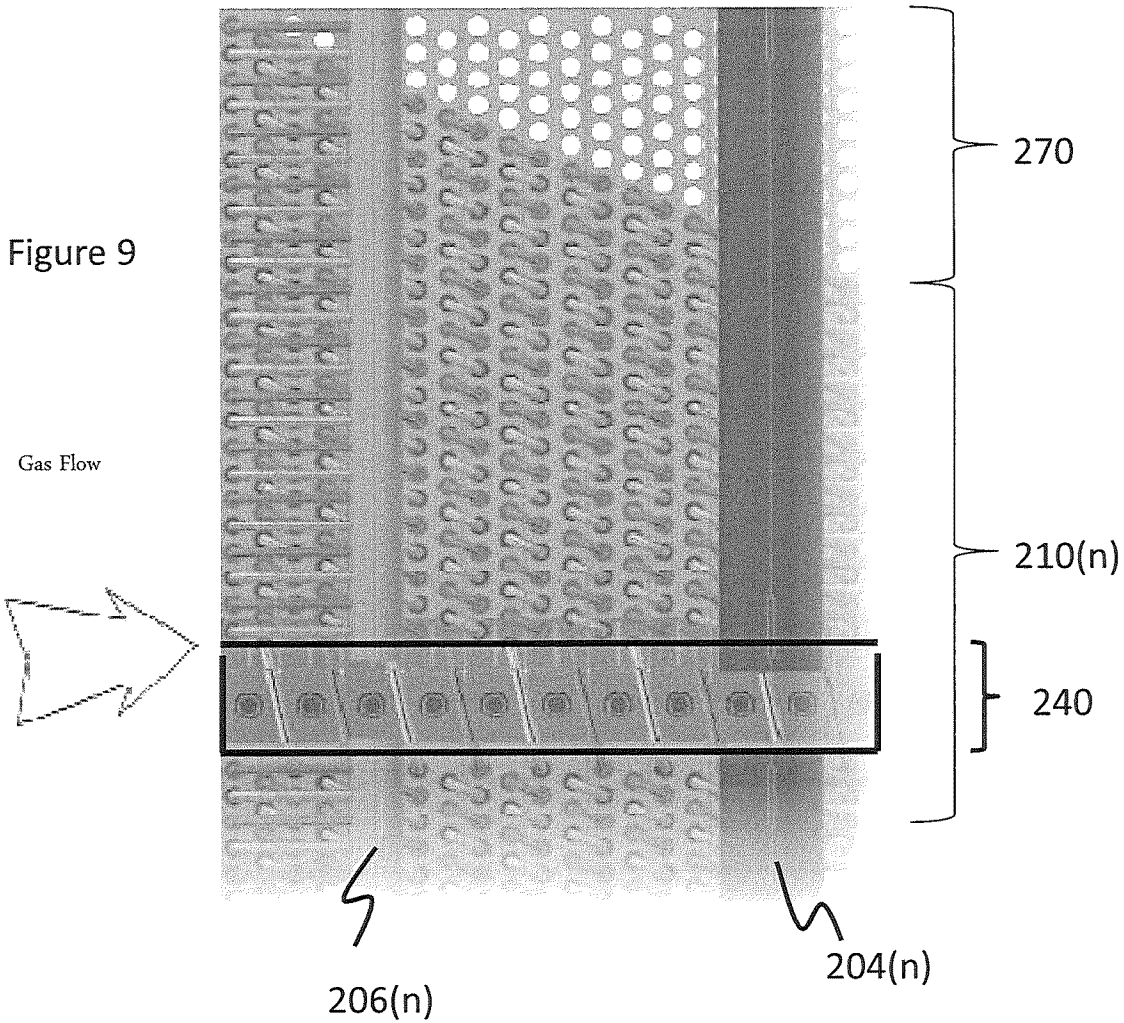
FIG. 9 depicts an end-on view of tubes that are inclined in one direction while being horizontal in another direction; it also shows on tube stack that spans across two once-through sections.

The FIG. 9 is another end-on elevation view of FIG. 7A counterflow and staggered arrangement. In this depiction, the tube stack 210(*n*) spans two sections, i.e., as seen in the figure the tube stack lies on both sides of the baffle 240. The tubes shown in the FIG. 8 are inclined in one direction, while being horizontal in a direction in a mutually perpendicular direction. In the arrangement depicted in the FIG. 8, the tubes are horizontal in a direction that is perpendicular to the gas flow, while being inclined in a direction parallel to the gas flow. The inclination of the tubes allows for unoccupied space that is used for controls or for providing fractional tube stacks (heating surface) that are in fluid communication with the inlet header and the outlet header and which are used for heating the working fluid.

In the FIG. 9, the contact between the respective tubes of the tube stack and the outlet header 206(*n*) is also depicted. As may be seen each tube from the tube stack contacts the header 206(*n*) where the working fluid is discharged to after being heated in the tube stack.

In the aforementioned arrangements (i.e., the staggered or the in-line arrangement variations) the hot gases from the furnace may travel through the tube stack without any directional change or they can be redirected across the heating surface via some form of flow controls and/or gas path change.

The staggered counterflow horizontally arranged heating surface (FIG. 6B) with horizontally/inclined arranged water/steam (working fluid) circuits permits a balance between increased minimum flow and increased pressure drop from a choking device. Furthermore, the heating surface is minimized due to the staggered and counterflow heat transfer mode leading to minimal draft loss and parasitic power. However, for a given balance, this may lead to high parasitic power loss due to the flow choking requirements and/or the separator water discharge considerations, or both. This is because the pressure drop across the flow choking device can be significant as can the water discharged from the separator.

For inline counter flow horizontally arranged heating surface (FIG. 8) with horizontally/inclined arranged water steam circuits, a balance between increased minimum flow and increased pressure drop from a choking device can be achieved wherein the minimum flow and flow choking device requirements are minimized due to the additional pressure drop taken by the tubes. This leads to a relatively low pressure drop across the flow choking device and minimizes the water discharge out of the separator. This device has a lower water/steam side parasitic loss as compared with the staggered counterflow horizontally arranged heating surface. However, additional heating surface is formed leading to additional parasitic power due to the added draft loss incurred. Note that a staggered heating surface arrangement could be employed to provide similar water/steam side advantages and avoid a draft loss penalty. This however, would lead to a significant number of low points with the once-through pressure part and severely limit drainability.

It is to be noted that this application is co-filed with U.S. Patent Applications having Ser. Nos. 61/587,230, 13/744,094, 13/744,104, 13/744,121, 61/587,402, 13/744,112, and 13/744,126, the entire contents of which are incorporated by reference herein.

Maximum Continuous Load" denotes the rated full load conditions of the power plant.

"Once-through evaporator section" of the boiler used to convert water to steam at various percentages of maximum continuous load (MCR).

"Approximately Horizontal Tube" is a tube horizontally orientated in nature. An "Inclined Tube" is a tube in neither a horizontal position or in a vertical position, but dispose at an angle therebetween relative to the inlet header and the outlet header as shown.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, singular forms like "a," or "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

The term and/or is used herein to mean both "and" as well as "or". For example, "A and/or B" is construed to mean A, B or A and B.

The transition term "comprising" is inclusive of the transition terms "consisting essentially of" and "consisting of" and can be interchanged for "comprising".

While this disclosure describes exemplary embodiments, it will be understood by those skilled in the art that various changes can be made and equivalents can be substituted for elements thereof without departing from the scope of the disclosed embodiments. In addition, many modifications can be made to adapt a particular situation or material to the teachings of this disclosure without departing from the essential scope thereof. Therefore, it is intended that this disclosure not be limited to the particular embodiment disclosed as the best mode contemplated for carrying out this disclosure.

What is claimed is:

1. A once-through horizontal evaporator comprising:

a horizontal duct to pass a flow of heated gas in a direction horizontally therethrough;

one or more inlet headers receiving a working fluid;

a plurality of tube stacks disposed the horizontal duct, the plurality of tube stacks being vertically stacked in the horizontal duct, whereby each tube stack receives a respective different horizontal portion of the flow of heated gas passing through the horizontal duct, each tube stack including a plurality of tubes, each respective tube being in fluid communication with the one or more inlet headers and having a serpentine shape with a plurality of horizontal tube portions, wherein each of the plurality of tubes of the tube stacks are disposed in a respective plane extending in the direction of the flow of the heated gas at an angle θ of less than 90 degrees or greater than 90 degrees to a vertical;

one or more outlet headers in fluid communication with the plurality of tubes of each of the tube stacks;

wherein the tubes of each tube stack are stacked vertically whereby each of the horizontal tube portions of each of the tubes being offset vertically relative to an adjacent tube to provide a staggered arrangement whereby the horizontal portions of two adjacently stacked tubes are disposed in different horizontal planes;

the plurality of tube stacks being arranged within the duct so that the direction of travel of the working fluid within the tube stacks is counterflow relative to the flow of heated gas through the horizontal duct;

the plurality of tube stacks and the horizontal duct forming an opening between an end of the tube stacks and the horizontal duct, the opening being an unoccupied space provided due to the inclination of the tube stacks; and a partial tube stack in fluid communication with one of the inlet headers and one of the outlet headers, the partial tube stack being disposed in the opening and filling the opening so that the plurality of tube stacks combine with the partial tube stack to form a rectangular shape.

2. The once-through evaporator of claim 1, wherein the tubes in one row of a respective tube stack are offset from the tubes in a preceding or succeeding row.

3. The once-through evaporator of claim 1, wherein the tubes in one row of a respective tube stack lie directly above the tubes in a succeeding row and directly below the tubes in a preceding row.

4. A method comprising:

discharging a working fluid through a once-through evaporator; where the once-through evaporator comprises:

a horizontal duct to pass a flow of heated gas in a direction horizontally therethrough;

one or more inlet headers receiving the working fluid;

a plurality of tube stacks disposed in the horizontal duct, the plurality of tube stacks being vertically stacked in the horizontal duct, whereby each tube stack receives a respective different horizontal portion of the flow of heated gas passing through the horizontal duct, each tube stack including a plurality of tubes, each respective tube being in fluid communication with the one or more inlet headers and having a serpentine shape with a plurality of horizontal tube portions, wherein each of the plurality of tubes of the tube stacks are disposed in a respective plane extending in the direction of the flow of the heated gas at an angle θ of less than 90 degrees or greater than 90 degrees to a vertical;

one or more outlet headers in fluid communication with the plurality of tubes of each of the tube stacks;

wherein the tubes of each tube stack are stacked vertically whereby each of the horizontal tube portions of each of the tubes being offset vertically relative to an adjacent tube to provide a staggered arrangement whereby the horizontal portions of two adjacently stacked tubes are disposed in different horizontal planes;

the plurality of tube stacks being arranged within the duct so that the direction of travel of the working fluid within the tube stacks is counterflow relative to the flow of heated gas through the horizontal duct;

the plurality of tube stacks and the horizontal duct forming an opening between an end of the tube stacks and the horizontal duct, the opening being an unoccupied space provided due to the inclination of the tube stacks, and a partial tube stack in fluid communication with one of the inlet headers and one of the outlet headers, the partial tube stack being disposed in the opening and filling the opening so that the plurality of tube stacks combine with the partial tube stack to form a rectangular shape;

discharging heated gas through the once-through evaporator; and transferring heat from the heated gas to the working fluid.

* * * * *